US005873677A

United States Patent [19]

Davies et al.

[11] Patent Number: 5,873,677

[45] Date of Patent: Feb. 23, 1999

[54] STRESS RELIEVING JOINT FOR RISER

[75] Inventors: Richard Lloyd Davies, Katy; Lyle David Finn, Sugar Land, both of Tex.

[73] Assignee: Deep Oil Technology, Incorporated, Houston, Tex.

[21] Appl. No.: 915,832

[22] Filed: Aug. 21, 1997

[51] Int. Cl.[6] ..... E21B 7/12; E21B 17/00

[52] U.S. Cl. ..... 405/195.1; 285/216; 405/202; 405/224

[58] Field of Search ..... 405/202, 195.1, 405/224, 224.2, 224.3; 285/223, 263, 209, 210, 215, 216; 403/41

[56] References Cited

U.S. PATENT DOCUMENTS

| | | | |
|---|---|---|---|
| 2,514,504 | 7/1950 | Moline | 285/216 X |
| 2,537,183 | 1/1951 | Bloomer | 285/216 X |
| 2,717,792 | 9/1955 | Pelley | 285/223 X |
| 3,548,079 | 12/1970 | Jones et al. | 285/158 |
| 4,212,561 | 7/1980 | Wipkink | 405/202 X |
| 4,363,567 | 12/1982 | Van Der Graaf | 405/202 X |
| 4,378,179 | 3/1983 | Hasle | 405/224 X |
| 4,633,801 | 1/1987 | Marshall | 405/202 X |

*Primary Examiner*—Dennis L. Taylor
*Attorney, Agent, or Firm*—Robert J. Edwards; D. Neil LaHaye

[57] ABSTRACT

A stress relieving joint for use with riser pipe in floating systems wherein a vessel is subject to variable motion caused by wind, currents, and wave action. The riser pipe has one end connectable to the sea floor and an upper portion adapted to pass through a constraining opening at the bottom of the vessel. A ball joint and socket assembly is removably attached to the keel at the constraint opening. A sleeve is attached at substantially its midpoint in the ball joint. Riser pipe received in the sleeve is provided with wear strips that reduces the rate of reduction in wear surface diameter.

4 Claims, 3 Drawing Sheets

STRESS RELIEVING JOINT FOR RISER

BACKGROUND OF THE INVENTION

1. Field of the Invention

The invention is generally related to the support of risers used in offshore structure and more particularly to the support of risers at the keel of floating offshore structures.

2. General Background

In the drilling and production of hydrocarbons offshore, the development of deep water operations from floating vessels has included the use of tendons and risers under tension extending from the vessel to the sea floor. Such floating vessels have included tension buoyant towers, and spar structures in which the floating structures extend well below the surface of the water and are subjected to heave, pitch, and roll motions.

The lower ends of the tendons and risers are connected to the sea floor by means of additional pipes or risers embedded in and grouted to the sea floor. The upper ends of the tendons and risers pass through openings in the keel or bottom portion of the vessels and are supported vertically by tensioning means located near the water surface.

The openings in the keel serve to constrain the pipe forming the tendons or risers when the vessel is moved laterally with respect to the sea floor connection. Such lateral movement produces bending of the pipe at the constraint opening or rotation of the pipe about the contact of the pipe with the edges of the opening. Bending of the pipe which is normally under tension results in fatigue and wear at the constraint opening.

Riser pipe diameters can vary according to the functional requirements for the riser with typical designs varying from three to twenty inches. The opening in the keel guide support frame, for present designs, is sized to pass the connector used to tie the riser to the subsea wellhead. This connector diameter typically varies from twenty-seven to forty-eight inches, depending on the style of tieback connector used. Previous keel sleeves were designed to fill the twenty-nine to fifty inch hole provided in the spar keel riser frame. This resulted in a large diameter and thus very heavy and costly keel sleeve. This large diameter keel sleeve was generally too stiff to efficiently provide the bend limiting function that is desired. In addition, the length of the keel sleeve was required to be quite long (fifty to sixty feet) to insure that the sleeve did not leave the keel guide as a result of relative motion between the floating structure and the riser.

Prior proposed means for controlling stress at such a point or area of rotation of the pipe have included tapered pipe wall sections of very large wall thickness. The thick tapered wall sections are usually machined from heavy forgings and are very expensive.

Pending U.S. application assigned Ser. No. 08/431,147 now U.S. Pat. No. 5,683,205 discloses a stress relieving joint wherein a sleeve member is ensleeved over the pipe portion at the constraint opening and has an inner diameter greater than the outer diameter of the pipe portion. Means at opposite ends of the sleeve centralize the pipe within the sleeve such that the bending stresses at the constraint opening are relieved and distributed to the pipe at the ends of the sleeve member.

The known art does not address the need for a riser support at the keel of a vessel that may be installed with the riser and is more readily removed and replaced if required due to damage, wear, and/or fatigue.

SUMMARY OF THE INVENTION

The invention addresses the above need. What is provided is a stress relieving joint for use with riser pipe in floating systems wherein a vessel is subject to variable motion caused by wind, currents, and wave action. The riser pipe has one end connectable to the sea floor and an upper portion adapted to pass through a constraining opening at the bottom of the vessel. A ball joint and socket assembly is removably attached to the keel at the constraint opening. A sleeve is attached at substantially its midpoint in the ball joint. Riser pipe received in the sleeve is provided with wear strips or suitable wear surface that reduces the rate of reduction in wear surface diameter.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
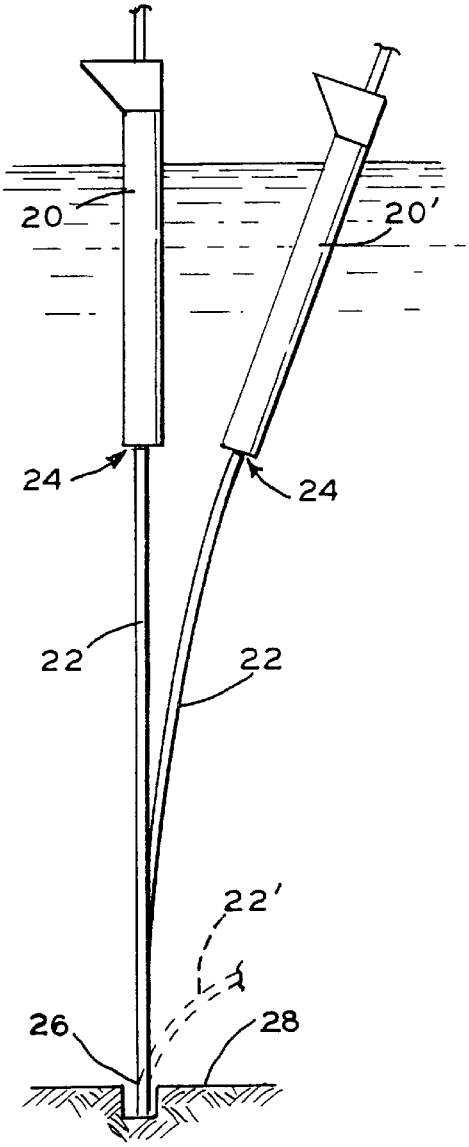
FIG. 1 is a schematic view of a floating vessel, sea floor, and pipe interconnecting the vessel and sea floor.

FIG. 1 generally and schematically shows a vessel 20 of spar, or tension buoyant tower type with a pipe 22 exiting from its bottom or keel as indicated by numeral 24 and having a suitable connection at 26 to the sea floor 28. Lateral horizontal excursion of the vessel 20 is indicated by its position at 20'. Bending stresses occur on the pipe 22 where it exits the vessel at 24 at the keel and at the sea floor connection at 26, the dotted lines 22' exaggerating such bending.

Figure 2:
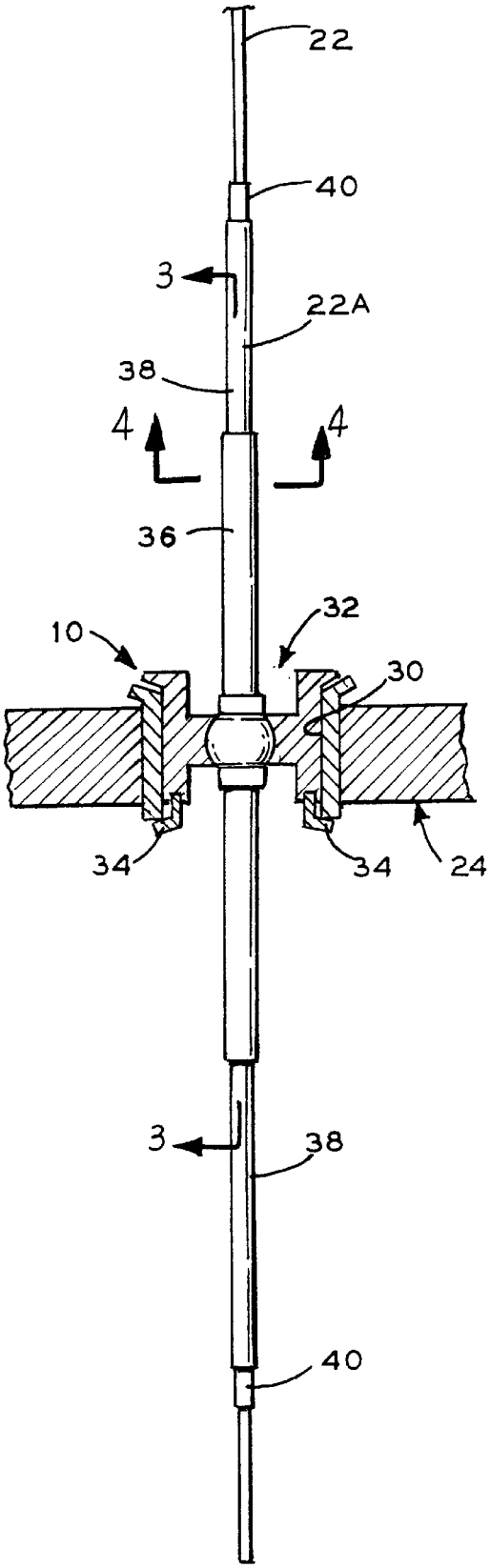
FIG. 2 is an enlarged detail view of a portion of FIG. 1 showing the keel opening of the vessel provided with the stress relief joint of this invention.

FIG. 2 illustrates the preferred embodiment of the invention, generally indicated by numeral 10. Stress relief joint 10 is generally comprised of ball joint and socket assembly 32, sleeve 36, and wear strips 38.

The keel 24 of the vessel has a number of openings 30, only one of which is shown for ease of illustration. The opening 30 is adapted to removably receive a ball joint and socket assembly 32. As it is well known, the ball joint and socket assembly allows relative freedom of movement in all planes around a line. The ball joint and socket assembly 32 is held in its installed position in the keel 24 by a latch 34, which allows the assembly to be installed or removed as required. This ball joint and socket assembly could be formed in several alternative ways. For example, it could be a metal ball and metal socket or an elastomeric "flex joint" where a gap between the ball and socket is filled with alternate layers of elastomeric material and metal.

Figure 3:
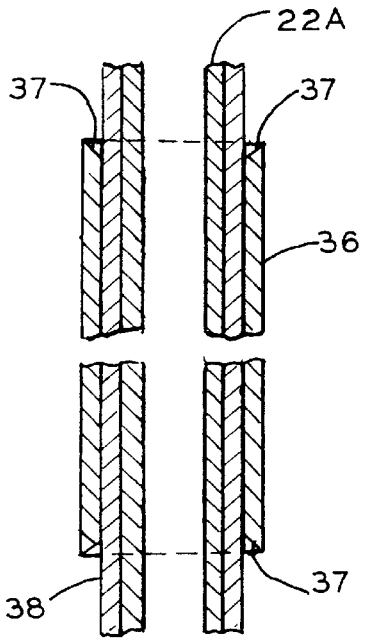
FIG. 3 is a view taken along lines 3—3 in FIG. 2.

Sleeve 36 is received in the ball joint and socket assembly 32 so as to be movable with the ball joint. Sleeve 36 is attached within the ball joint at substantially the midpoint of the sleeve. As a result of this attachment, there is no relative vertical motion between the vessel 20 and the sleeve 36. This allows the sleeve 36 to be much shorter than that used with previous designs. As seen in FIG. 3, the inner diameter of each end of the sleeve 36 is beveled outwardly, indicated by numeral 37, to minimize damage to the wear strips 38.

Figure 4:
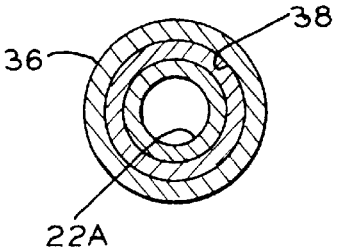
FIG. 4 is a view taken along lines 4—4 in FIG. 2.

The inside diameter of the sleeve 36 is sized to receive a section of riser pipe 22A that has wear strips 38 attached thereto, seen in FIG. 3 and 4. The wear strips 38 essentially fill the annulus between the sleeve and the pipe and provide a much larger wear surface than that provided by the riser pipe alone. Thus, the rate of reduction in wear surface diameter is less than with present designs. The riser pipe with the wear strips 38 attached is preferably heavy duty riser pipe and is indicated by numeral 22A.

It is also preferable that the riser couplings 40 be positioned as far as possible from the ends of the sleeve 36. If necessary to limit the length of the riser pipe segments, a riser coupling 40 may also be located near the center of the keel sleeve 36. Either arrangement places the riser couplings far away from points of high bending stress. This eliminates the need for the more expensive connectors that are required with present designs where the connectors are placed in high stress regions and are required to resist the high loads and potential fatigue damage.

In operation, once the vessel is in place and it is time to install the risers, the ball joint and socket assembly 32 and sleeve 36 are lowered with the riser pipe 22 and landed in the opening 30 in the keel 24. Latch 34 is used to lock the ball joint and socket assembly 32 in place. The remaining riser segments are attached to each other and run through the sleeve 36.

Figure 5:
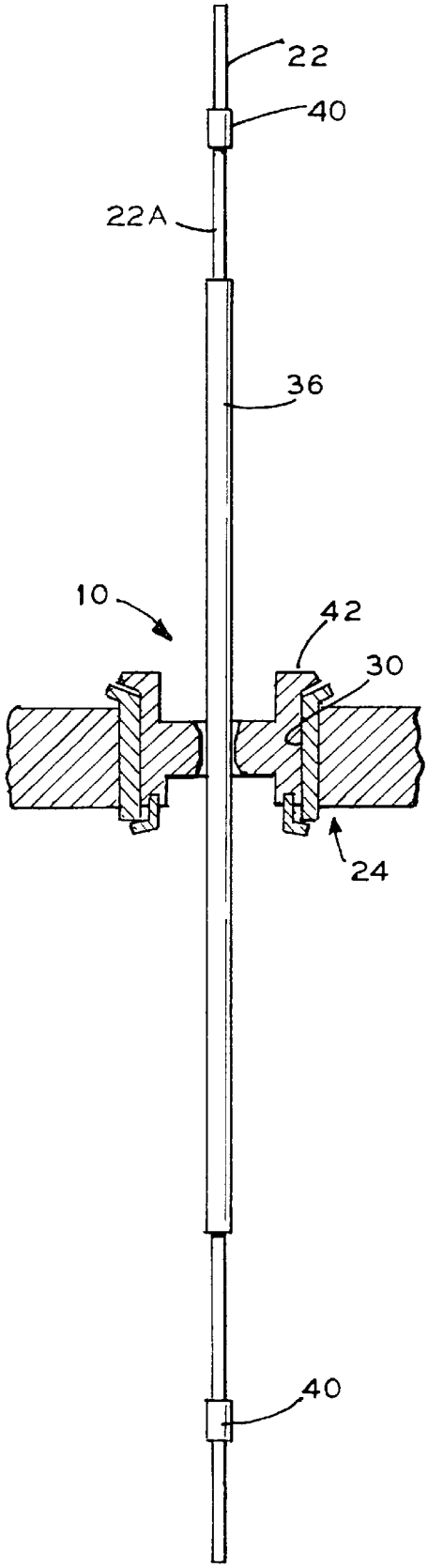
FIG. 5 illustrates an alternate embodiment of the invention.

FIG. 5 illustrates an alternate embodiment of the invention wherein the sleeve 36 is attached to heavy duty riser pipe 22A instead of the keel guide insert 42. The riser couplings 40 are located as described for the preferred embodiment. The alternate embodiment has the same advantages as the preferred embodiment in that the sleeve 36 is smaller in diameter than the present designs and can be designed to more efficiently provide the desired bend limiting function. The effective of the sleeve 36 in the alternate embodiment can be enhanced by reducing the bending the bending stiffness of the sleeve as a function of distance away from the keel guide insert 42. This may be accomplished by reducing the diameter and/or the thickness of the sleeve 36.

Figure 6:
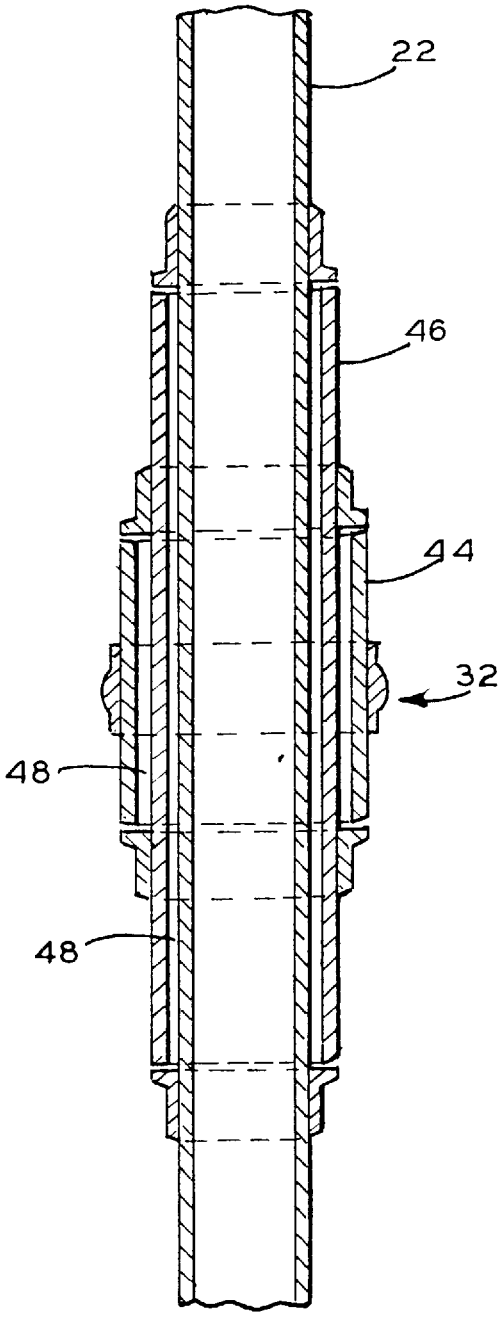
FIG. 6 illustrates an alternate embodiment of the sleeve of the invention.

As shown in FIG. 6, an alternate sleeve configuration may employ two or more concentric pipe segments 44 and 46, with each inner pipe segment extending a selected distance beyond each end of the immediately surrounding pipe segment. Also, a durable and pliable material, indicated by numeral 48, may be used to fill the annulus between concentric pipe segments 44, 46, and 22.

It should be understood that the ball and socket assembly 32 is only one suitable embodiment of pivoting function provided by the invention. A universal joint, similar to that used on a vehicle drive shaft is also suitable.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A stress relieving joint for use with pipe in floating systems wherein a vessel is subject to variable motion caused by wind, currents, and wave action, said pipe having one end connectable to the sea floor and an upper pipe portion adapted to pass through a constraining opening at the bottom of the vessel, the stress relieving joint comprising:

a. a ball joint and socket assembly removably received at the constraining opening of the vessel;

b. a sleeve received through and attached to said ball joint and socket assembly such that said sleeve extends inside and outside the vessel on either side of the constraining opening and is ensleeved over the pipe portion at the constraint opening, said sleeve having an inner diameter greater than the outer diameter of the pipe portion; and c. wear strips attached to the pipe portion received in said sleeve, said wear strips substantially filling the annulus between the pipe portion and said sleeve and extending a selected distance beyond either end of said sleeve.

2. The stress relieving joint of claim 1, wherein the pipe portion received in said sleeve comprises heavy duty riser pipe.

3. The stress relieving joint of claim 1, wherein the ends of said sleeve are beveled.

4. The stress relieving joint of claim 1, wherein said sleeve is formed from at least two concentric pipe segments, with each innermost pipe segment extending a selected distance beyond each end of the immediately surrounding pipe segment.

* * * * *